US008398230B2

(12) United States Patent
Matsuhashi

(10) Patent No.: US 8,398,230 B2
(45) Date of Patent: Mar. 19, 2013

(54) DRYING APPARATUS, RECORDING APPARATUS, AND DRYING METHOD

(75) Inventor: Kunihiko Matsuhashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 13/031,872

(22) Filed: Feb. 22, 2011

(65) Prior Publication Data

US 2011/0216139 A1 Sep. 8, 2011

(30) Foreign Application Priority Data

Mar. 3, 2010 (JP) ..... 2010-046303

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS 4,151,658 A * 5/1979 Hibino et al. ..... 34/523
4,984,316 A * 1/1991 Simpson et al. ..... 5/658

FOREIGN PATENT DOCUMENTS

JP 2009-196111 A 9/2009

* cited by examiner

*Primary Examiner* — Stephen Meier
*Assistant Examiner* — Tracey McMillion
(74) *Attorney, Agent, or Firm* — Global IP Counselors, LLP

(57) ABSTRACT

A drying apparatus includes a fluid supply mechanism configured to supply a fluid as a heat medium for controlling a target to a desired temperature. The fluid supply mechanism supplies the fluid to a space region disposed on one surface side of the target, to increase the pressure in the target from the one surface side.

11 Claims, 7 Drawing Sheets

DRYING APPARATUS, RECORDING APPARATUS, AND DRYING METHOD

CROSS-REFERENCE TO RELATED APPLICATIONS

This application claims priority to Japanese Patent Application No. 2010-046303 filed on Mar. 3, 2010. The entire disclosure of Japanese Patent Application No. 2010-046303 is hereby incorporated herein by reference.

BACKGROUND

1. Technical Field

The present invention relates to a drying apparatus, a recording apparatus, and a drying method.

2. Related Art

Inkjet printers that eject ink onto a target have been widely known in the past as recording apparatuses. Such printers include those that comprise a heating and drying apparatus for heating the target in order to dry the ink deposited on the target (Patent Citation 1, for example).

In the heating and drying apparatus of Japanese Laid-Open Patent Publication No. 2009-196111, within a drying case, the solvent properties of the ink are exhibited by blowing warm air onto a surface of the target on which a recording process has been performed.

SUMMARY

In this type of heating and drying apparatus, the drying time can be reduced if the temperature of the air being blown is increased. However, when the temperature of the air is increased, there is an increase in uneven temperatures caused by the manner in which the air is blown, and problems have been encountered in that drying becomes uneven in low-temperature portions, or localized deformation occurs in the target in high-temperature portions.

The present invention was devised in view of the problems described above, and an object thereof is to provide a drying apparatus, a recording apparatus, and a drying method whereby uneven temperatures can be reduced.

To achieve the object described above, a drying apparatus according to a first aspect of the present invention includes a fluid supply mechanism configured to supply a fluid as a heat medium for controlling a target to a desired temperature. The fluid supply mechanism supplies the fluid to a space region disposed on one surface side of the target to increase pressure on the target from the one surface side.

According to this configuration, since the fluid supply mechanism supplies air as a heat medium to the space region disposed on the one surface side of the target, the target can be heated and dried by the fluid. Since the fluid increases the pressure of the target by coming in contact with the one surface side of the target, unevenness in temperature can be reduced when the target is controlled to the desired temperature.

In the drying apparatus as described above, the target is preferably a bag having an opening, and the fluid supply mechanism increases the pressure in the bag from the inside by filling the bag with the fluid through the opening.

According to this configuration, since the target is a bag having an opening, the fluid supply mechanism can increase the pressure in the bag from the inside by filling the bag with the fluid through the opening.

The drying apparatus as described above preferably further includes an opening/closing mechanism configured to open and close the opening of the target.

According to this configuration, the opening of the bag can be opened by the opening/closing mechanism before the bag is filled with the fluid, and the opening of the bag can be closed after the bag is filled with the fluid.

The drying apparatus as described above preferably further includes a holding part configured to hold the target, a rotating member configured to rotate in a state of supporting a plurality of the holding parts, and an orientation-holding member configured to hold the orientation of the target during the rotation.

According to this configuration, the target can be conveyed while a drying time of the target is ensured, due to the rotation of the rotating member. Since the orientation-holding member holds the orientation of the target during rotation, the holding parts can release their hold on the target at any arbitrary rotational position. Consequently, the drying time and length of the conveyed route of the target can be easily varied.

The drying apparatus as described above preferably further includes a frame member that comes in contact with one surface side of the target, to form enclosing and to form the space region.

According to this configuration, the frame member can enclose and form the space region by coming in contact with the one surface side of the target.

In the drying apparatus as described above, the frame member preferably includes a fixed frame extending along a conveying direction of the target and a movable frame extending along a width direction of the target, which is orthogonal to the conveying direction, wherein the movable frame is provided so as to be capable of moving relative to the fixed frame along the conveying direction.

According to this configuration, the range of the space region can be changed by the movable frame moving relative to the fixed frame along the conveying direction.

In the drying apparatus as described above, a recording process is preferably performed on the front surface side of the target, and the fluid supply mechanism supplies the fluid to the space region disposed on the reverse surface side of the target.

According to this configuration, since the fluid supply mechanism supplies the fluid to the space region disposed on the reverse surface side of the target, the front surface side which has undergone the recording process can be dried while the target is increased in pressure from the reverse surface side.

The drying apparatus as described above preferably further includes an air-blowing fan for blowing air onto the front surface side of the target.

According to this configuration, drying of the front surface of the target which has undergone the recording process can be facilitated by the air-blowing fan blowing air onto the front surface side.

In the drying apparatus as described above, the fluid supply mechanism preferably has a heater for heating the fluid, and after the fluid heated by the heater has been supplied, room temperature fluid that has not been heated by the heater is supplied in order to reduce the temperature of the target while the pressure applied to the space region is maintained.

According to this configuration, since the fluid supply mechanism supplies room temperature fluid after supplying fluid that has been heated by the heater, the temperature of the target can be reduced while the pressure of the space region is maintained. The localized deformation of the target caused by uneven temperatures can thereby be suppressed.

The drying apparatus as described above preferably further includes a suction device configured to suction the space region.

According to this configuration, the state of increased pressure in the target can be dispelled by the suction device suctioning the space region.

To achieve the objects drying apparatus, a recording apparatus according to another aspect of the present invention includes a recording unit configured to perform a recording process on a target, and the drying apparatus described above.

According to this configuration, since the fluid supply mechanism supplies a fluid as a heat medium to the space region disposed on one surface side of the target, the target can be heated and dried by the heat medium. Since the fluid increases the pressure of the target by coming in contact with one surface side of the target, uneven temperatures can be reduced when the target is controlled to the desired temperature. The target, having undergone the recording process, can thereby be dried uniformly.

To achieve the objects described above, a drying method of the present invention includes increasing the pressure in a target from one surface side by supplying a space region disposed on one surface side of the target, with a fluid as a heat medium for controlling the target to a desired temperature.

According to this configuration, in the pressure increase step, since the target is increased in pressure from one surface side by the fluid as a heat medium being supplied to the space region disposed on one surface side of the target, uneven temperatures can be reduced when the target is controlled to the desired temperature.

BRIEF DESCRIPTION OF THE DRAWINGS

Referring now to the attached drawings which form a part of this original disclosure:

FIGS. 2A to 2C are cross-sectional views showing the configuration of a sandwiching part, wherein FIG. 2A is a cross-sectional view along line A-A in FIG. 1, FIG. 2B is a cross-sectional view along line B-B in FIG. 1, and FIG. 2C is a cross-sectional view along line C-C in FIG. 1;

DETAILED DESCRIPTION OF EXEMPLARY EMBODIMENTS

First Embodiment

Figure 1:
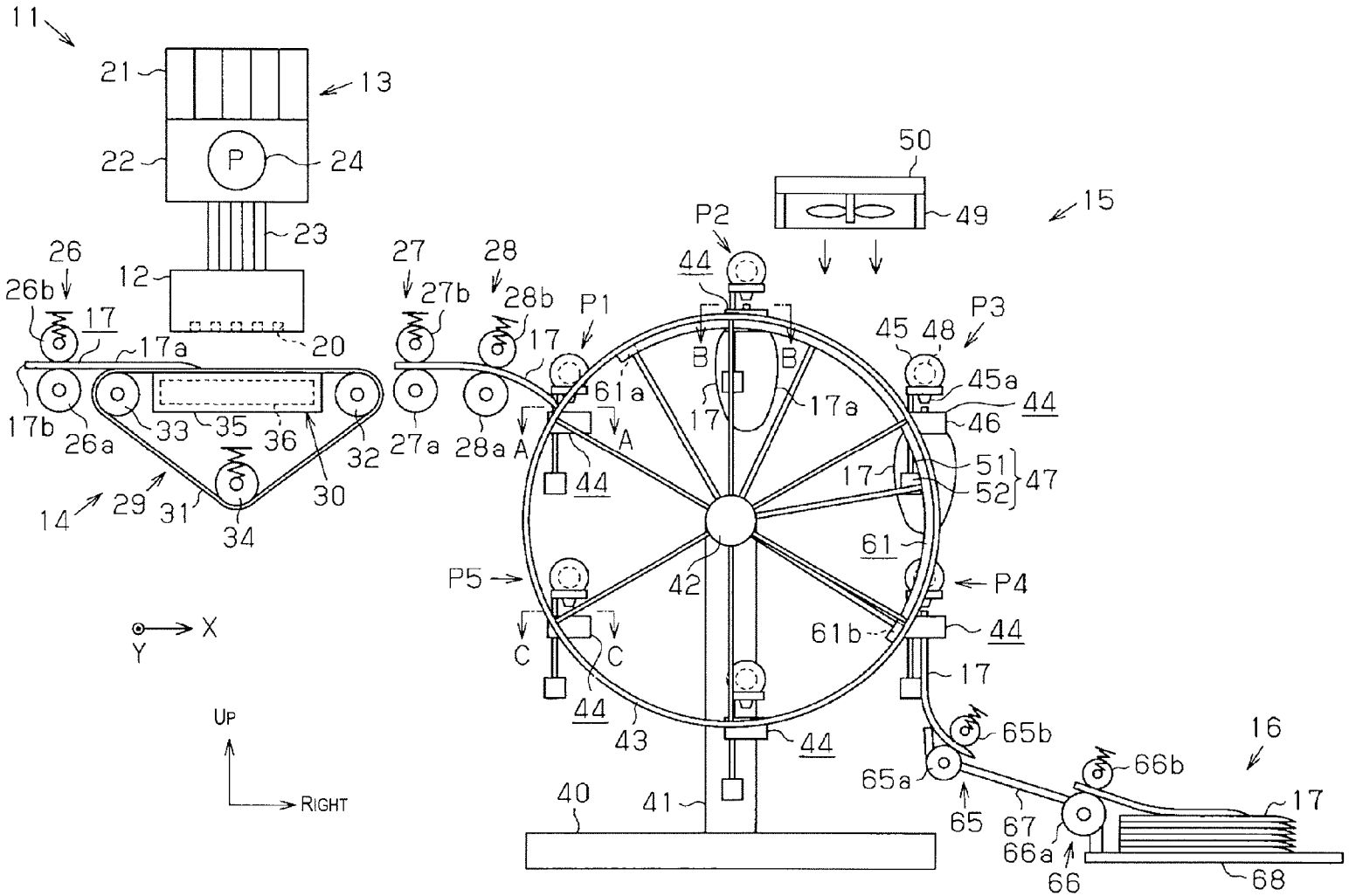
FIG. 1 is a front view showing the configuration of the recording apparatus in the first embodiment.

The first embodiment is described hereinbelow with reference to FIGS. 1 through 3, wherein the present invention is specified as an inkjet printer (hereinbelow referred to simply as "a printer"), one type of a recording apparatus. In the following description, when a "forward-backward direction," a "left-right direction," and an "up-down direction" are mentioned, they are referring respectively to the forward-backward direction, the left-right direction, and the up-down direction shown by the arrow in the drawings.

The printer 11 comprises a recording head 12 as a recording unit, an ink supply mechanism 13 for supplying ink to the recording head 12, a conveying apparatus 14, a drying apparatus 15, and a stacking portion 16, as shown in FIG. 1. In the present embodiment, the printer 11 is designed to perform a recording process in the recording apparatus to which the recording head 12 is provided, and to perform the recording process on an external surface 17*a* (the surface facing upward) of a bag 17 has a target composed of a resin film, for example. The bag 17 is conveyed to a recording position in a state such that an opening 17*b* is disposed at the rear end (the left end), which is on the upstream side in the conveying direction X (the right in FIG. 1).

The underside of the recording head 12 is provided with a plurality of nozzles 20 for ejecting ink droplets along the conveying direction X and a width direction Y (the forward-backward direction). A nozzle row is configured by nozzles 20 aligned in the width direction Y. A plurality of these nozzle rows are provided for each ink color along the conveying direction X.

The ink supply mechanism 13 comprises a cartridge holder 22, an ink supply tube 23 connecting the cartridge holder 22 and the recording head 12, and a pressure pump 24. A plurality of ink cartridges 21 containing ink are removably installed in the cartridge holder 22. The pressure pump 24 increases the pressure in the ink cartridges 21 and thereby supplies ink to the recording head 12 on the downstream side.

The conveying apparatus 14 comprises conveying rollers 26, 27, 28, a belt conveyor apparatus 29 disposed between the conveying roller 26 and the conveying roller 27, and a holding mechanism 30. The conveying rollers 26, 27, 28 are each configured from drive rollers 26*a*, 27*a*, 28*a* for supporting the bag 17 from below and applying propelling force to the bag 17, and driven rollers 26*b*, 27*b*, 28*b* urged toward the drive rollers 26*a*, 27*a*, 28*a*.

The belt conveyor apparatus 29 comprises a conveyor belt 31, a drive roller 32 for applying rotational force to the conveyor belt 31, a driven roller 33, and a driven roller 34 for applying tension to the conveyor belt 31. The conveyor belt 31 wound over the drive roller 32 and the driven rollers 33, 34 is designed to move circumferentially along with the rotational driving of the drive roller 32. A plurality of through-holes (not shown) are also formed in the conveyor belt 31.

The holding mechanism 30 comprises a platen 35 for supporting the bag 17 via the conveyor belt 31 in the recording position, and a suction mechanism 36 for holding the bag 17 on the conveyor belt 31 by suction through the through-holes to the conveyor belt 31. When the bag 17 being conveyed by the conveyor belt 31 passes through the recording position, the recording process is performed on the external surface 17*a* of the bag 17 by ejecting ink droplets from the recording head 12. The bag 17 on which the recording process has been performed on the external surface 17*a* is conveyed toward the drying apparatus 15 along with the rotational driving of the drive rollers 27*a*, 28*a* while being sandwiched between the pair of conveying rollers 27, 28.

Next, the drying apparatus 15 will be described.

The drying apparatus 15 comprises a base stand 40, a supporting part 41 standing upright from the base stand 40, and a ring frame 43 as a rotary member that is rotatably supported on the supporting part 41 via a rotating shaft 42. Supported on the ring frame 43 in a turnable manner are a plurality (six in the present embodiment) of holding parts 44 disposed at equal intervals in the circumferential direction.

The holding parts 44 each have a blow fan 45 as a liquid supply mechanism and a suction device, a sandwiching part 46 for sandwiching the bag 17 and functioning as an opening/ closing mechanism, and an orientation-holding member 47 for holding the orientations of the bag 17 and blow fan 45.

The blow fan 45 is equipped with a heater 48 for heating air as a fluid, and air can be blown out and drawn in via an air intake/exhaust port 45*a*. The blow fan 45 blows hot air (air that has been heated by the heater 48) through the opening 17*b* into the bag 17 sandwiched in the sandwiching part 46, whereby the pressure in the bag 17 is increased from the inside. In other words, in order to dry the external surface 17*a* of the bag 17 where the printing process has been performed, air as a heating medium for controlling the bag 17 to the desired temperature is supplied to a space region R (see FIG. 2) to which the reverse surface (the inside surface) is exposed (the space region R is disposed on the reverse surface side of the bag 17).

The drying apparatus 15 also has an air-blowing fan 49 for blowing air onto the external surface 17*a* on which the recording process has been performed. The air-blowing fan 49 is provided with a heater 50. The air-blowing fan 49 blows warm air that has been heated by the heater 50 onto the external surface 17*a*, which is the front surface of the bag 17.

The orientation-holding member 47 comprises a support shaft 51 extending in the up-down direction, and a weight 52 fixed to the bottom end of the support shaft 51. The blow fan 45 is fixed to the top end of the support shaft 51. The blow fan 45 is held by the orientation-holding member 47 in an orientation in which the air intake/exhaust port 45*a* faces downward.

The sandwiching part 46 comprises a first shaft 55, a second shaft 57, clamp rollers 58 supported on the first shaft 55 via rotating shafts 58*a*, and clamp rollers 59 supported on the second shaft 57 via rotating shafts 59*a*, as shown in FIG. 2. Two ring frames 43 are provided in the forward-backward direction, and the first shaft 55 spans between the ring frames 43 in a freely turning state. The second shaft 57 is provided to the right of the first shaft 55 so as to be parallel with the first shaft 55. The rotating shafts 58*a*, 59*a* are cylindrically shaped and are turnably placed over the first shaft 55 and the second shaft 57, respectively.

Figure 2A:
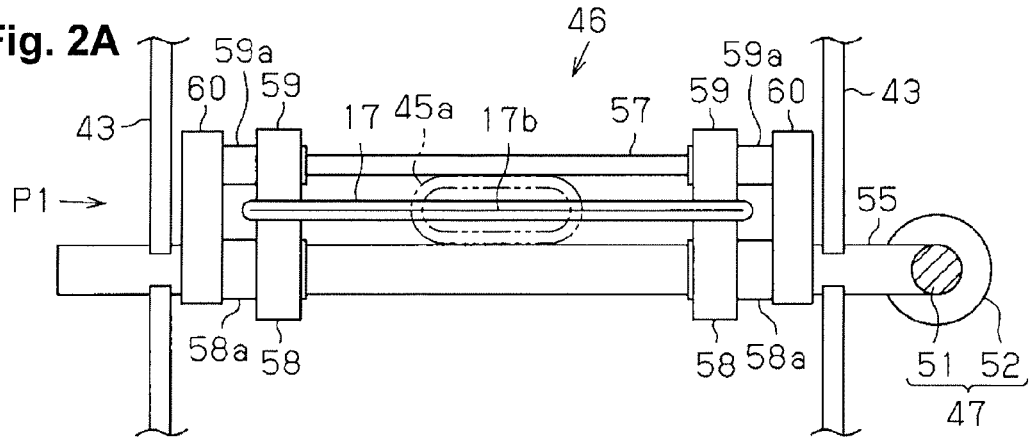

Two of each of the clamp rollers 58, 59 and the rotating shafts 58*a*, 59*a* are provided along the width direction Y, and the clamp rollers 58 and clamp rollers 59 are disposed in alignment in the left-right direction so as to constitute a pair. The sandwiching part 46 is designed so that the clamp rollers 58, 59 as a pair sandwich the bag 17 in a state in which the opening 17*b* faces upward, as shown in FIG. 2A.

The first shaft 55 extending in the forward-backward direction is connected at one end (the rear end) to the support shaft 51 of the orientation-holding member 47. Consequently, the bag 17 sandwiched in the sandwiching part 46 has its orientation held by the orientation-holding member 47 so that the opening 17*b* faces the air intake/exhaust port 45*a* of the blow fan 45.

The first shaft 55 is connected to the second shaft 57, which extends in the forward-backward direction, via two connecting members 60 aligned in the width direction Y. The connecting members 60 are connected with the clamp rollers 58 via the rotating shafts 58*a*, and are also connected with the clamp rollers 59 via the rotating shafts 59*a*.

The connecting members 60 have a motor (not shown) for rotating at least one of the rotating shafts 58*a* and the rotating shafts 59*a*. The clamp rollers 58, 59 are designed so as to be rotated by the rotational driving of this motor via the rotating shafts 58*a*, 59*a*. A single motor is provided for rotating the clamp rollers 58, 59, and this motor may be connected to the plurality of sandwiching parts 46 so as to be capable of transmitting motive force.

The connecting members 60 have urging members (not shown) for urging the rotating shafts 58*a* and the rotating shafts 59*a*, which are aligned along the left-right direction, in directions towards each other. The clamp rollers 58, 59 sandwich the bag 17 through the urging force of these urging members. In a standby position P5 (see FIG. 1) where the bag 17 is not sandwiched, the clamp rollers 58, 59 are in a state of contact with each other as shown in FIG. 2C.

The two connecting members 60 aligned in the width direction Y are connected to each other via an urging member (not shown) (e.g., a compression coil spring), and a pair of guide parts 61 supported on the supporting part 41 are provided at positions adjacent to the inner sides of the ring frames 43.

The guide parts 61 have arcuate shapes running along the shapes of the ring frames 43, and slopes 61*a*, 61*b* are provided at the end portions of the guide parts 61, as shown in FIG. 1. The slopes 61*a* at the distal ends of the guide parts 61 are disposed between a sandwiching position P1 and a first fill-starting position P2, and the slopes 61*b* at the rear ends of the guide parts 61 are disposed between a suction position P4 and a discharge position where the bag 17 is released from being sandwiched by the sandwiching parts 46.

Figure 2B:
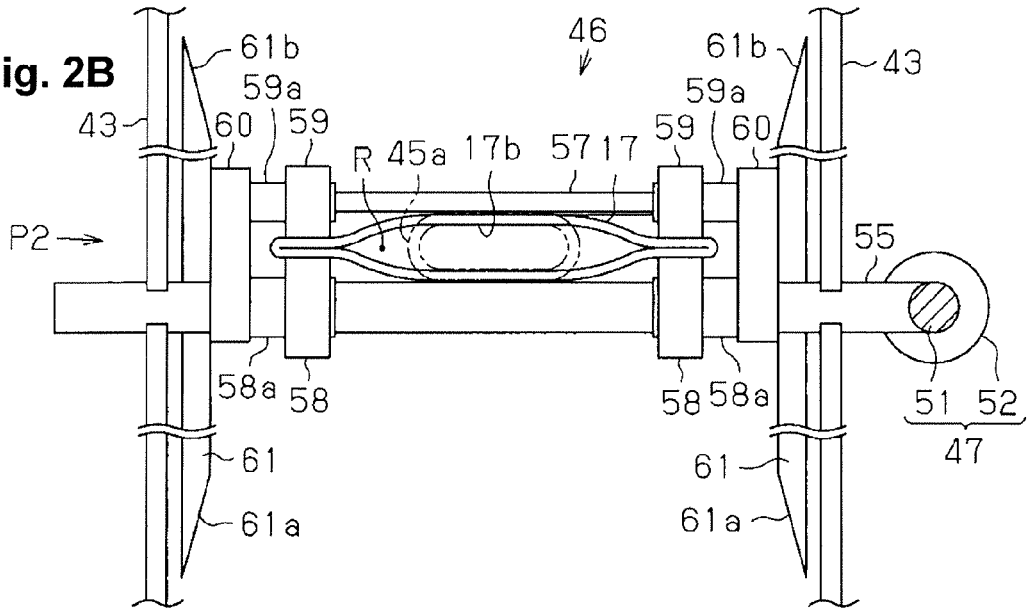
Figure 2C:
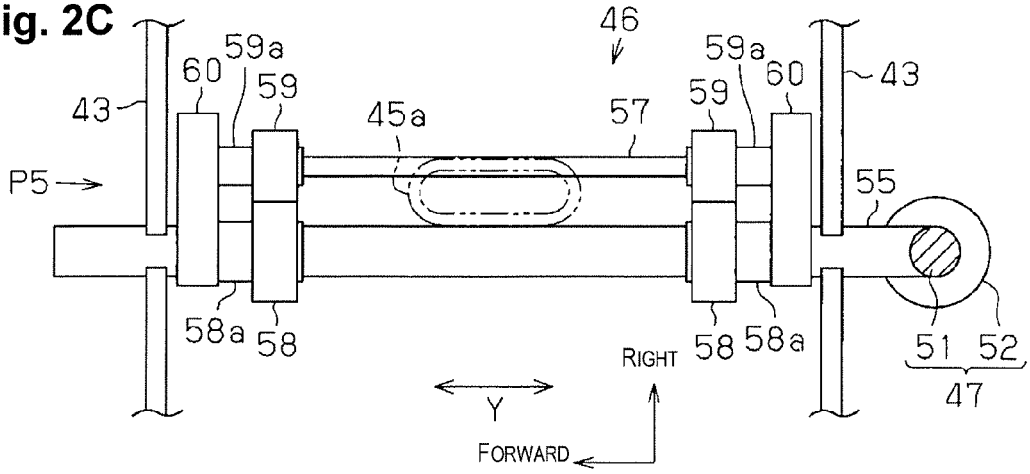

The slopes 61*a* of the guide parts 61 are formed so as to narrow the route by which the connecting members 60 move as the ring frames 43 rotate, as shown in FIG. 2B. Therefore, as the ring frames 43 rotate and the connecting members 60 slide along the slopes 61*a*, the connecting members 60 move in directions towards each other against the urging force of the urging members whereby they are connected. The connecting members 60 move towards each other in a state in which the bag 17 is sandwiched by the clamp rollers 58, 59, whereby the opening 17*b* of the bag 17 is opened up.

The slopes 61*b* of the guide parts 61 are formed so as to widen the route by which the connecting members 60 move as the ring frames 43 rotate. Therefore, as the ring frames 43 and the connecting members 60 slide along the slopes 61*b*, the connecting members 60 move in directions away from each other due to the urging force of the urging members. The connecting members 60 move away from each other in a state in which the bag 17 is sandwiched by the clamp rollers 58, 59, whereby the opening 17*b* of the bag 17 is closed.

Next, the stacking portion 16 will be described.

The stacking portion 16 comprises pairs of conveying rollers 65, 66, a conveying guide part 67, and a placement part 68, and the stacking portion 16 is disposed to the right of the drying apparatus 15 as shown in FIG. 1. The conveying rollers 65, 66 are configured respectively from drive rollers 65*a*, 66*a* for supporting the bag 17 from below and applying propelling force to the bag 17, and driven rollers 65*b*, 66*b* which are urged toward the drive rollers 65*a*, 66*a*.

The conveying guide part 67 forms a conveying route for the bags 17 being conveyed from the conveying roller pair 65 to the conveying rollers 66. The bags 17 conveyed along the conveying direction X by the conveying rollers 65, 66 come to be placed in a stacked formation on the placement part 68 disposed to the right of the conveying guide part 67.

Next, the drying method in the drying apparatus 15 will be described.

Figure 3:
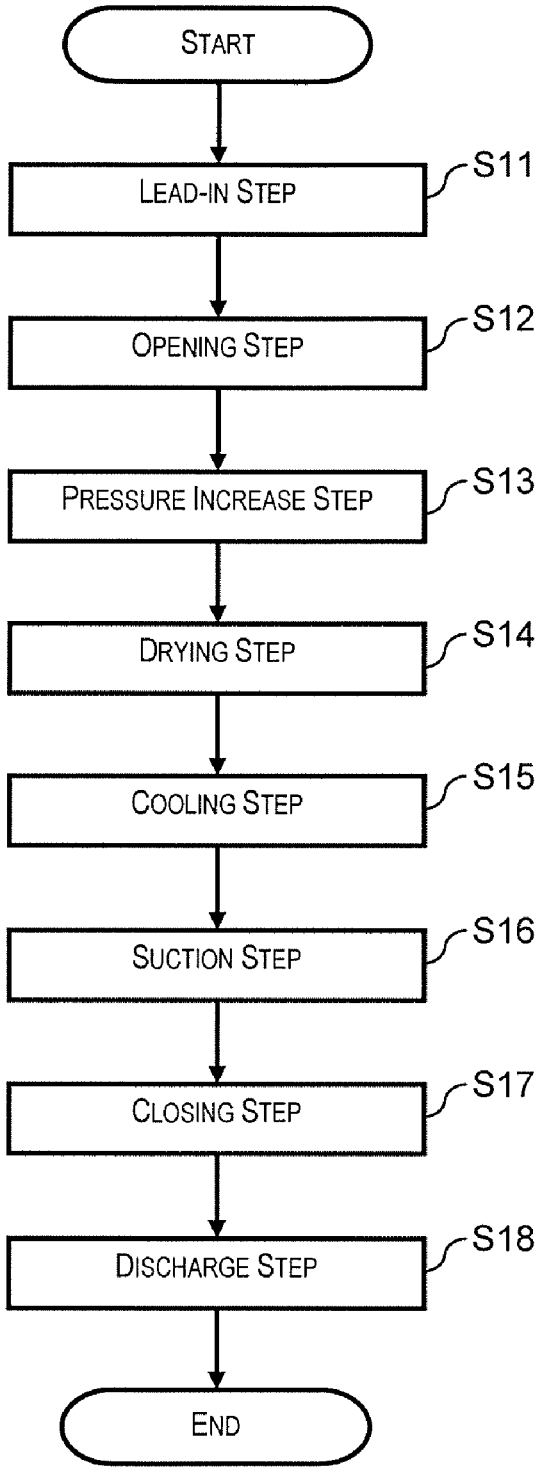
FIG. 3 is a flowchart for describing the drying method in the first embodiment.

The drying method in the drying apparatus 15 involves the following sequence as shown in FIG. 3: a lead-in step of step S11, an opening step of step S12, a pressure increase step of step S13, a drying step of step S14, a cooling step of step S15, a suction step of step 16, a closing step of step 17, and a discharge step of step 18. These steps are performed continuously during the process in which the ring frames 43 of the drying apparatus 15 rotate in the clockwise direction in FIG. 1.

First, in the lead-in step of step S11, when the bag 17 is conveyed in by the conveying rollers 28 as shown in FIG. 1, the clamp rollers 58, 59 rotate and the bag 17 is sandwiched in the sandwiching position P1. When the clamp rollers 58, 59 have sandwiched the vicinity of the opening 17*b* of the bag 17, the clamp rollers 58, 59 stop rotating. The bag 17 is thereby led into the drying apparatus 15.

Next, in the opening step of step S12, the connecting members 60 engage with the guide parts 61 along with the rotation of the ring frames 43. The opening 17*b* of the bag 17 is thereby opened.

Next, in the pressure increase step of step S13, the blow fan 45 begins to supply hot air at the first fill-starting position P2. Heated air is thereby supplied into the bag 17 through the opened opening 17*b*, and the bag 17 is heated while increasing in pressure from the inside.

Next, in the drying step of step S14, between the first fill-starting position P2 and the second fill-starting position P3, hot air continues to be supplied into the bag 17 by the blow fan 45, and warm air is supplied by the air-blowing fan 49 onto the external surface 17*a* of the bag 17. The blow fan 45 and the air-blowing fan 49 may begin to blow air simultaneously, or the air-blowing fan 49 may begin to blow air before the blow fan 45. In other words, the pressure increase step may be performed as part of the drying step.

The higher the surrounding temperature, the faster the drying of the ink deposited on the external surface 17*a* of the bag 17. When the ink dries, the solvent of the ink evaporates, whereby the vapor pressure of the front surface of the bag 17, which is an evaporation surface, approaches a saturated vapor pressure. In a still air layer (diffusion layer) in which air near the evaporation surface does not move, a vapor pressure gradient is formed from the saturated vapor pressure to the vapor pressure of the surrounding outside air which has not reached saturation. In view of this, by blowing air onto the external surface 17*a* of the bag 17 and thinning the diffusion layer, the vapor pressure gradient can be increased and evaporation of the ink solvent can be facilitated.

Since the bag 17 is composed of a resin film, when hot air is blown onto the opened external surface 17*a*, uneven temperatures occur and low-temperature spots are insufficiently dried, or localized deformation occurs in high-temperature spots. In view of this, in the printer 11, hot air of about 60 to 80 degrees is supplied to the space region R to which the inside surfaces of the bag 17 are exposed, increasing the pressure of the bag 17 from the inside, whereby the bag 17 is heated uniformly, warm air of about 40 to 55 degrees is blown onto the external surface 17*a* of the bag 17, and drying of the ink is facilitated. The pressure during heating is preferably sufficient to cause tension in the bag 17, and can be set to about 5 kPa, for example.

Next, in the cooling step of step S15, at the second fill-starting position P3, the blow fan 45 begins to supply room temperature air that has not been heated by the heater 48. Specifically, the blow fan 45 supplies room temperature air after supplying hot air that has been heated by the heater 48, whereby the pressure of the space region R in the bag 17 is maintained and the temperature of the bag 17 is reduced.

The bag 17 is thereby cooled and returned to room temperature while the state of increased pressure is maintained. Since the bag 17 expands like a balloon due to being heated by the hot air, heat deformation may occur depending on the heating temperature or the material of the bag 17, but since pressure is applied uniformly to the bag 17, the localized deformation that occurs with the temperature increase is suppressed. Since the bag 17 is filled with room temperature (low temperature) air after being filled with hot air, the temperature of the bag 17 can be reduced while the expanded shape of the bag 17 is maintained. The localized deformation that occurs with the temperature decrease of the bag 17 is thereby suppressed.

If necessary, the air-blowing fan 49 may continue to blow air during the cooling step. In this case, the air-blowing fan 49 may also blow room temperature air that has not been heated by the heater 50.

Next, in the suction step of step 16, the blow fan 45 suctions out the interior of the bag 17 in the suction position P4. The state of increased pressure inside the bag 17 is thereby dispelled, resulting in negative pressure, and the bag 17 becomes flat. When the bag 17 becomes flat, the drive rollers 65*a*, 66*a* of the conveying rollers 65, 66 are rotatably driven, and the bottom end of the bag 17 is sandwiched in the conveying rollers 65.

Next, in the closing step of step 17, the sandwiching part 46 and the guide parts 61 cease to be engaged along with the rotation of the ring frames 43, whereupon the opening 17*b* of the bag 17 is closed.

Next, in the discharge step of step 18, the clamp rollers 58, 59 rotate and the bag 17 moves away from the holding part 44. The bag 17 is thereby discharged from the drying apparatus 15 and placed on the stacking portion 16 by the conveying rollers 65, 66.

According to the embodiment drying apparatus, the following effects can be achieved.

(1) In the pressure increase step, since the blow fan 45 supplies air as a heating medium to the space region R disposed on a side of the inside surfaces of the bag 17, the bag 17 can be heated and dried by the heated air. Since the heated air increases the pressure of the bag 17 from the inside surfaces, unevenness in temperature can be reduced when the bag 17 is controlled to the desired temperature. The bag 17, having undergone the recording process, can thereby be uniformly dried. Since the bag 17 can be heated at a high temperature, the drying time can be greatly reduced, and the localized deformation in the bag 17 can be suppressed.

(2) Since the bag 17 has an opening 17*b*, the blow fan 45 can increase the pressure in the bag 17 from the inside by filling the bag 17 with air through the opening 17*b*.

(3) Since the sandwiching part 46 is provided for opening and closing the opening 17*b* of the bag 17, the opening 17*b* of the bag 17 can be opened by the sandwiching part 46 before the bag 17 is filled with air, and the opening 17*b* of the bag 17 can be closed after the bag is filled with air.

(4) The bag 17 can be conveyed while a drying time of the bag 17 is ensured, due to the rotation of the ring frames 43. Since the orientation-holding member 47 holds the orientation of the bag 17 during rotation, the holding parts 44 can release their hold on the bag 17 at any arbitrary rotational position. Consequently, the drying time and length of the conveyed route of the bag 17 can be easily varied.

Since the bag 17 can be dried while hanging from the holding parts 44, the bag 17 can be uniformly increased in pressure and heated. Consequently, when the recording process has been performed on a plurality of surfaces of the bag 17, the surfaces can be dried simultaneously.

(5) Since the blow fan 45 supplies air into the space region R disposed on the reverse surface side (the inside surface) of the bag 17, the front surface side which has undergone the recording process can be dried while the bag 17 is increased in pressure from the reverse surface side.

(6) Drying of the external surface 17*a* of the bag 17 which has undergone the recording process can be facilitated by the air-blowing fan 49 flowing air onto the external surface 17*a* of the bag 17.

(7) Since the blow fan 45 supplies room temperature air after air heated by the heater 48 has been supplied, the temperature of the bag 17 can be reduced while the pressure of the space region R is maintained. The localized deformation of the bag 17 caused by uneven temperatures can thereby be suppressed.

(8) Since the drying apparatus 15 comprises a blow fan 45 capable of suctioning the space region R, the state of increased pressure in the bag 17 can be dispelled and the bags can be flattened and placed on the stacking portion 16 due to the blow fan 45 suctioning out the space region R.

Second Embodiment

Next, the second embodiment of the present invention will be described with reference to FIGS. 4 through 7. In the printer 11 of the second embodiment, the recording process is performed on a front surface 70*a* (the top surface) of a rectangular sheet 70 as a target, after which a drying process is performed by a drying apparatus 71.

The drying apparatus 71 of the second embodiment is described hereinbelow.

Figure 4:
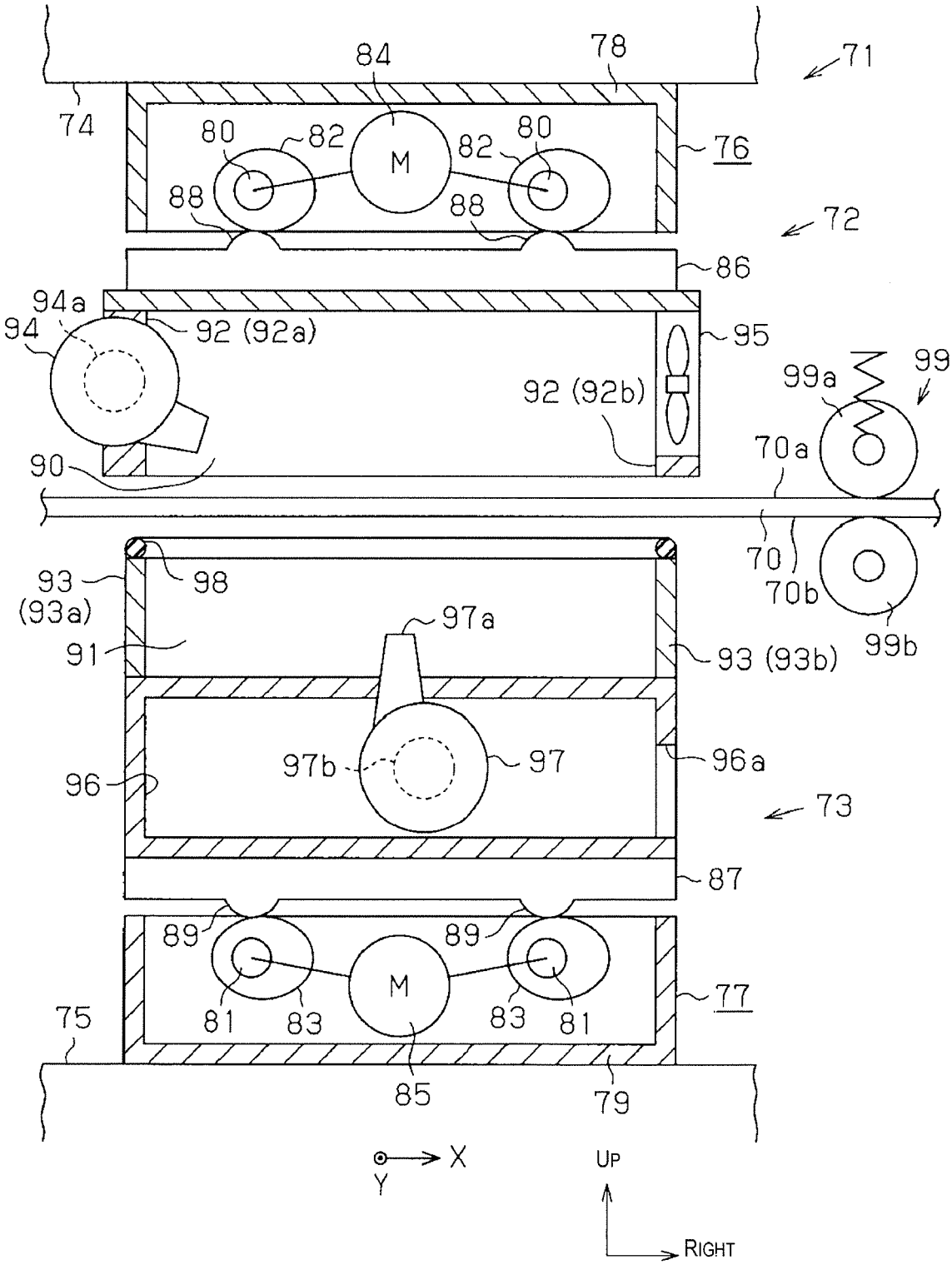
FIG. 4 is a cross-sectional view showing the configuration of the drying apparatus in the second embodiment.

The drying apparatus 71 comprises a warm air blowing unit 72 disposed above the sheet 70, and a hot air blowing unit 73 disposed underneath the sheet 70, as shown in FIG. 4. The warm air blowing unit 72 and the hot air blowing unit 73 are provided at positions facing each other from either side of the sheet 70 in the up-down direction.

The warm air blowing unit 72 and the hot air blowing unit 73 respectively comprise drive units 76, 77 supported on main frames 74, 75 of the printer 11. The drive units 76, 77 respectively comprise first frames 78, 79 fixed on the main frames 74, 75, pairs of turning shafts 80, 81 turnably supported on the first frames 78, 79, cam members 82, 83 provided so as to turn integrally with the turning shafts 80, 81, and motors 84, 85 for turning the turning shafts 80, 81.

The warm air blowing unit 72 and the hot air blowing unit 73 respectively comprise second frames 86, 87 as frame members that are urged by urging members (not shown) in directions toward the main frames 74, 75. Protruding from the second frames 86, 87, respectively, are cam followers 88, 89 provided at positions corresponding to cam members 82, 83.

Therefore, in the warm air blowing unit 72, the second frame 86 moves downward when the cam members 82 are turned by the forward driving of the motor 84, and the second frame 86 moves upward when the cam members 82 are returned to their original positions by the reverse driving of the motor 84. In the hot air blowing unit 73, the second frame 87 moves upward when the cam members 83 are turned by the forward driving of the motor 85, and the second frame 86 moves downward when the cam members 83 are returned to their original positions by the reverse driving of the motor 85.

Figure 5:
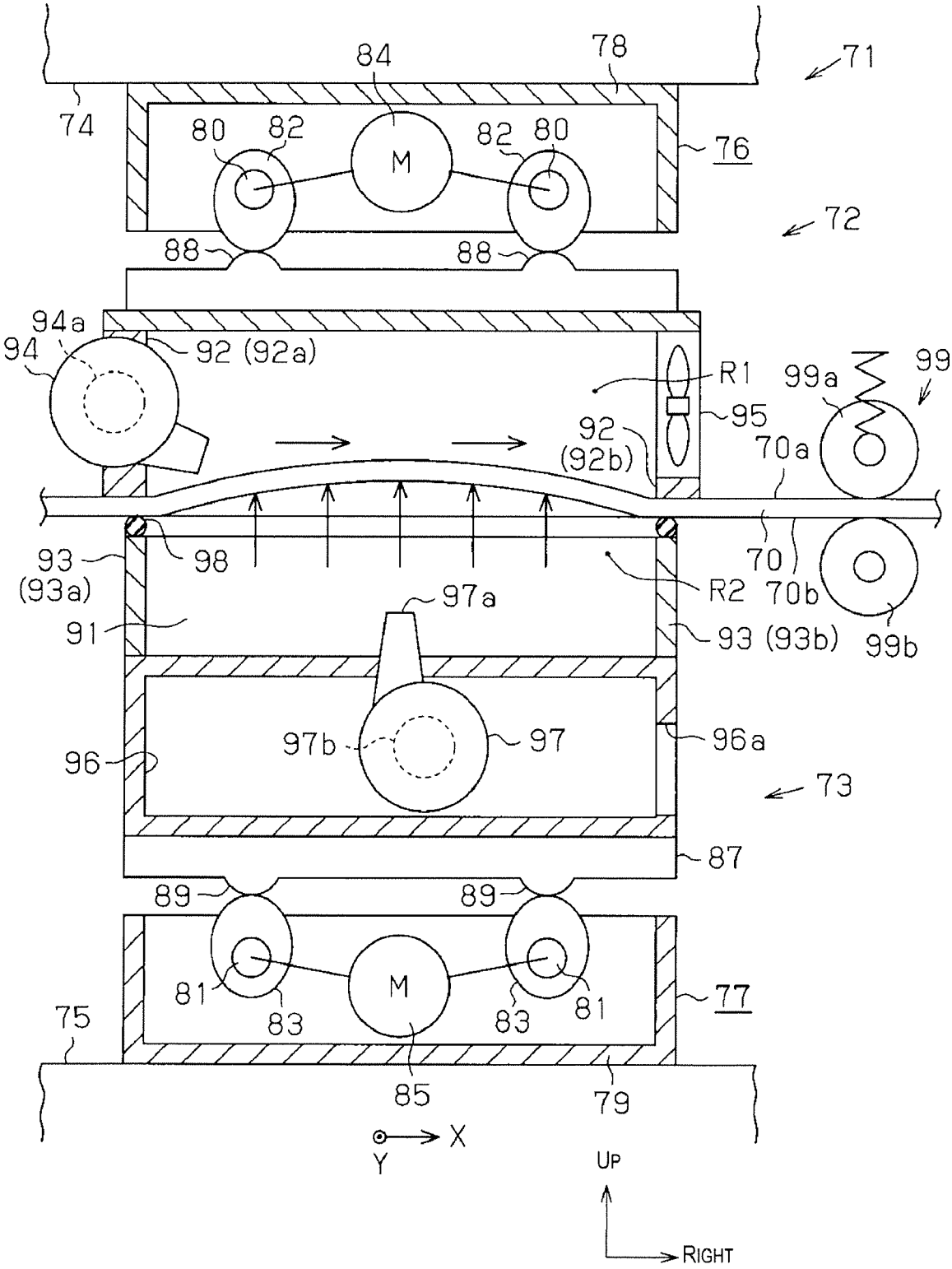
FIG. 5 is a cross-sectional view for describing the action of the drying apparatus in the second embodiment.

The second frames 86, 87 respectively have fixed frames 90, 91 extending along the conveying direction X, and movable frames 92, 93 extending along the width direction Y orthogonal to the conveying direction X. The second frame 86 moves downward and comes in contact with the front surface 70*a* of the sheet 70, thereby enclosing and forming a space region R1 as shown in FIG. 5. The second frame 87 of the hot air blowing unit 73 moves upward and comes in contact with the reverse surface 70*b* of the sheet 70, thereby enclosing and forming a space region R2.

Figure 6A:
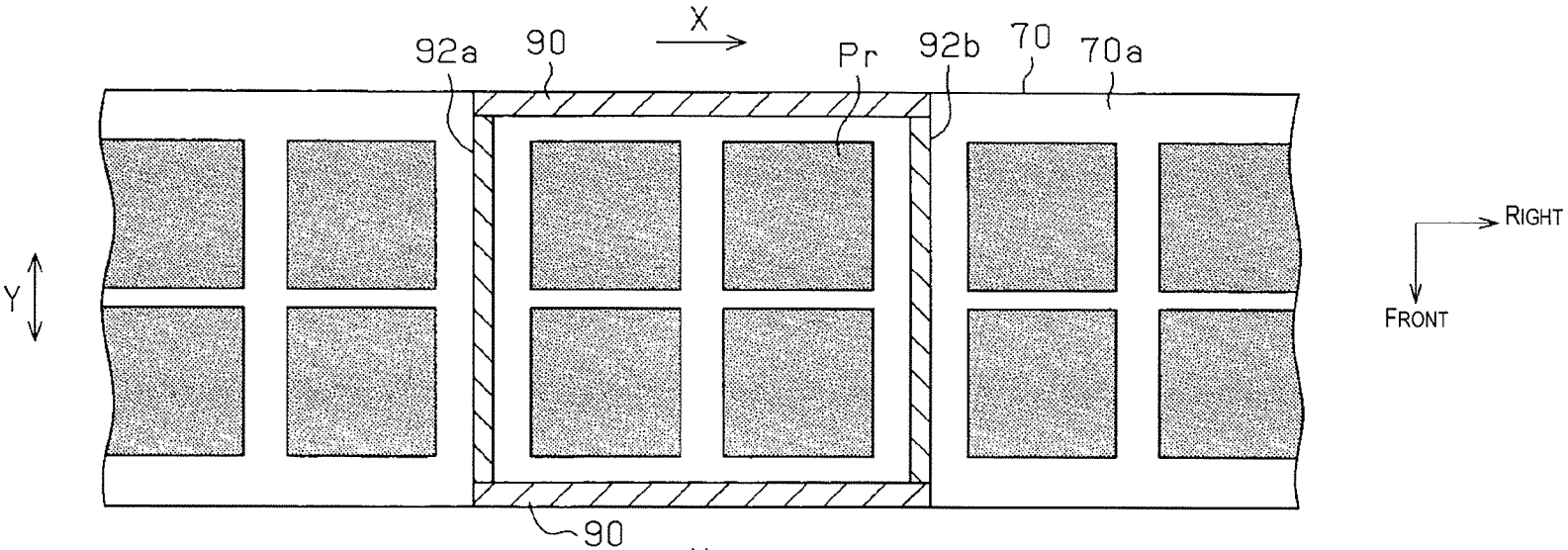
FIGS. 6A and 6B are cross-sectional views for describing the action of the movable frames.
Figure 6B:
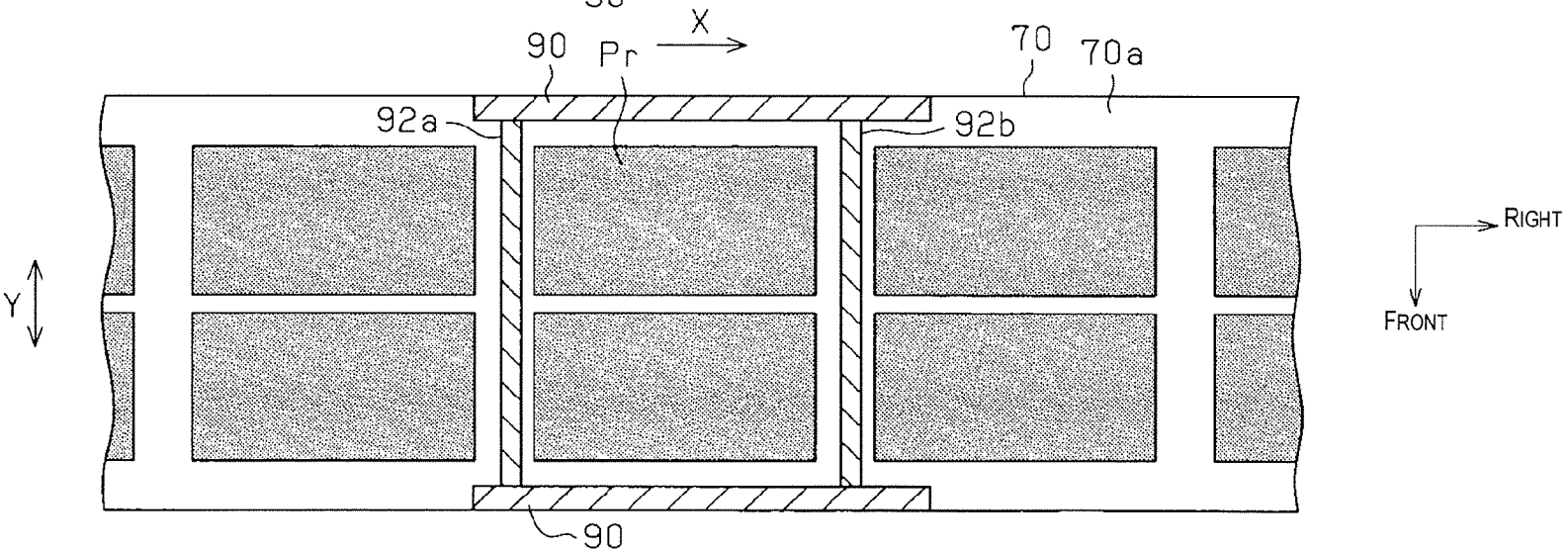

The movable frames 92, 93 respectively have left walls 92*a*, 93*a* and right walls 92*b*, 93*b*, which constitute pairs. The left wall 92*a* and right wall 92*b* of the movable frame 92 and the left wall 93*a* and right wall 93*b* of the movable frame 93 respectively move relative to the fixed frames 90, 91 along the conveying direction X, thereby changing the volumes of the space regions R1, R2 as shown in FIGS. 6A and 6B. The fixed frames 90, 91 and the movable frames 92, 93 are disposed so that the second frames 86, 87 sandwich the sheet 70 from the up-down direction when coming in contact with the sheet 70, and the space region R1 is in the drying position in the drying apparatus 71.

In the warm air blowing unit 72, an air-blowing fan 94 which blows air onto the front surface 70*a* of the sheet 70 is provided in the left wall 92*a* of the movable frame 92, as shown in FIG. 5. A heater 94*a* is installed in the air-blowing fan 94. Also in the warm air blowing unit 72, an air ventilation fan 95 for venting out the air inside the space region R1 is provided in the right wall 92*b* of the movable frame 92.

In the second frame 87 of the hot air blowing unit 73, an accommodating part 96 having an aeration hole 96*a* is provided in a position between the fixed frame 91 and the cam followers 89 in the up-down direction. The accommodating part 96 accommodates a blow fan 97 as a fluid supply mechanism disposed so that an air-blowing port 97*a* is positioned in the space region R2. A heater 97*b* is installed in the blow fan 97. In the second frame 87, a sealing part 98 composed of a rubber member is provided to the top end of the hot air blowing unit 73 where the fixed frame 91 and the movable frame 93 come in contact with the sheet 70.

In the second embodiment, a leveling roller 99 for flattening the sheet 70 is provided to the right of the drying apparatus 71 instead of the stacking portion 16 of the first embodiment. The leveling roller 99 is configured from a drive roller 99*a* for applying propelling force to the sheet 70 and a driven roller 99*b* urged toward the drive roller 99*a*, and these rollers have cylindrical shapes extending in the width direction Y.

Next, the drying method in the drying apparatus 71 will be described.

Figure 7:
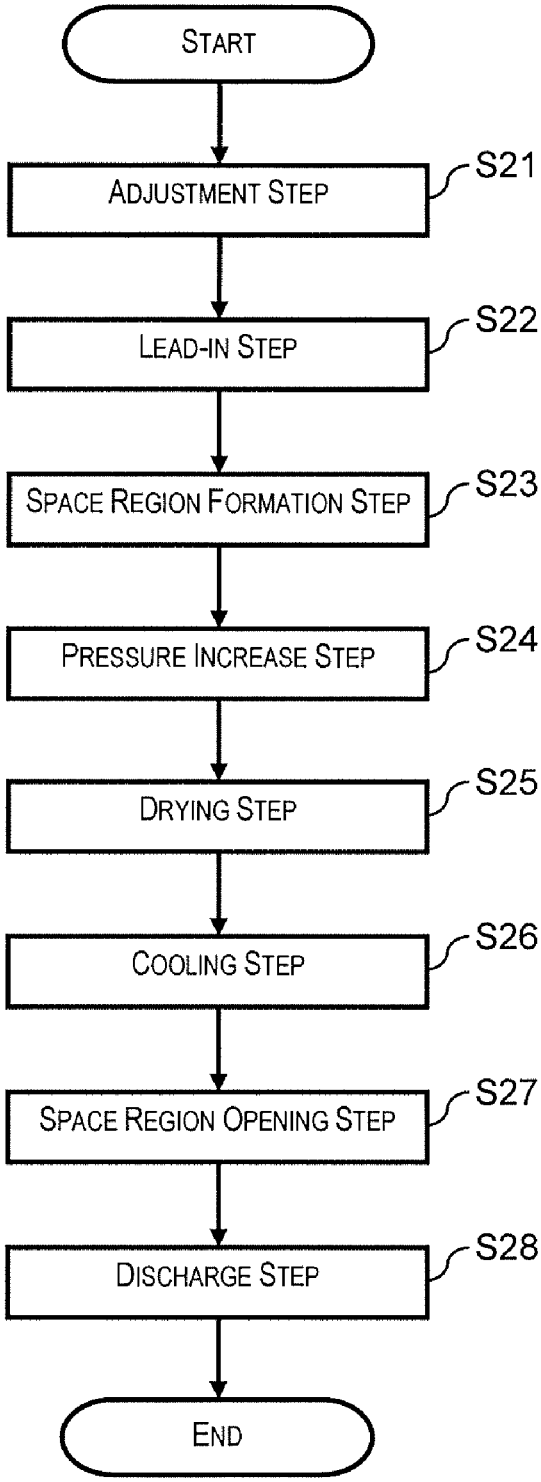
FIG. 7 is a flowchart for describing the drying method in the second embodiment.

The drying method in the drying apparatus 71 involves the following sequence as shown in FIG. 7: an adjustment step of step S21, a lead-in step of step S22, a space region formation step of step S23, a pressure increase step of step S24, a drying step of step S25, a cooling step of step S26, a space region opening step of step 27, and a discharge step of step 28.

First, in the adjustment step of step S21, the movable frame 92 of the warm air blowing unit 72 moves along the conveying direction X so as to cover the recording surface Pr on which the recording process has been performed as shown in FIGS. 6A and 6B, thereby adjusting the range of the space region R1. The movable frame 93 of the hot air blowing unit 73 also moves so as to correspond respectively with the movable frame 92, thereby adjusting the range of the space region R2.

Next, in the lead-in step of step S22, the sheet 70 on which the recording process has been performed is conveyed along the conveying direction X and is stopped when the recording surface Pr is disposed in the drying position. The adjustment step of step S21 may be performed after the lead-in step of step S22, or the adjustment step of step S21 and the lead-in step of step S22 may be performed simultaneously.

Next, in the space region formation step of step S23, the motors 84, 85 of the warm air blowing unit 72 and the hot air blowing unit 73 are driven forward, whereby the respective turning shafts 80, 81 and cam members 82, 83 are turned together. The cam members 82 of the warm air blowing unit 72 then push on the cam followers 88 and move the second frame 86 downward, and the cam members 83 of the hot air blowing unit 73 push on the cam followers 89 and move the second frame 87 upward. The fixed frame 90 and movable frame 92 of the second frame 86 thereby come in contact with the front surface 70*a* of the sheet 70, enclosing and forming the space region R1, and the sealing part 98 of the second frame 87 comes in contact with the reverse surface 70*b* of the sheet 70, enclosing and forming the space region R2.

Next, in the pressure increase step of step S24, the blow fan 97 of the hot air blowing unit 73 supplies the space region R2 with air (hot air) that has been heated to about 60 to 80 degrees by the heater 97*b*, thereby increasing the pressure in the space region R2 to about 5 kPa. The pressure is thereby increased on the reverse surface 70*b* of the sheet 70 exposed to the space region R2, and the sheet 70 positioned in the space region R2 is heated by the hot air. At this time, the sheet 70 sometimes swells in a direction of expanding the volume of the space region R2 due to the pressure difference between the space region R1 and the space region R2, as shown in FIG. 5.

Next, in the drying step of step S25, the air-blowing fan 94 of the warm air blowing unit 72 blows air (warm air) that has been heated to about 40 to 55 degrees by the heater 94*a* onto the front surface 70*a* of the space region R1, and the air ventilation fan 95 vents out the air in the space region R1. Drying of the ink deposited on the recording surface Pr is thereby facilitated. The blow fan 97 and the air-blowing fan 94 may begin to blow air simultaneously, or the air-blowing fan 94 may begin to blow air before the blow fan 97. Specifically, the pressure increase step may be performed as part of the drying step.

Next, in the cooling step of step S26, in order to reduce the temperature of the sheet 70 while maintaining the pressure of the space region R2, the blow fan 97 supplies the space region R2 with room temperature air that has not been heated by the heater 97*b*. The sheet 70 is thereby cooled and returned to room temperature.

Next, in the space region opening step of step 27, the motors 84, 85 of the warm air blowing unit 72 and the hot air blowing unit 73 are driven in reverse, whereby the respective cam members 82, 83 are turned back to their original positions. The second frames 86, 87 thereby move in directions away from the sheet 70, and the space regions R1, R2 are opened.

Lastly, in the discharge step of step 28, the sheet 70 is conveyed along the conveying direction X. At this time, conveying is performed by the leveling roller 99, whereby the sheet 70, which has been deformed by the increase in pressure, is then flattened.

According to the embodiments described above, the following effects can be achieved.

(9) In the pressure increase step, the blow fan 97 supplies air as a heat medium to the space region R2 to which the reverse surface 70*b* of the sheet 70 is exposed, and the sheet 70 can therefore be heated and dried by the heated air. Since the heated air increases the pressure of the sheet 70 from the side of the reverse surface 70*b*, uneven temperatures can be reduced when the sheet 70 is controlled to the desired temperature. The sheet 70 on which the recording process has been performed can thereby be dried uniformly. Since the sheet 70 is heated to a high temperature, the drying time can be greatly reduced, and localized deformation in the recording surface Pr can be suppressed.

(10) Since the blow fan 97 supplies air to the space region R2 to which the reverse surface 70*b* of the sheet 70 is exposed, the front surface 70*a* on which the recording process has been performed can be dried while the pressure is increased on the sheet 70 from the side of the reverse surface 70*b*.

(11) Drying of the front surface 70*a* of the sheet 70 on which the recording process has been performed can be facilitated by the air-blowing fan 94 flowing air onto the front surface 70*a* of the sheet 70. Increases in the solvent concentration of the space region R1 can be suppressed by the air ventilation fan 95 venting out the air in the space region R1.

(12) Since the blow fan 97 supplies room temperature air after air heated by the heater 97*b* has been supplied, the temperature of the sheet 70 can be reduced while the pressure in the space region R2 is maintained. Localized deformation of the recording surface Pr caused by uneven temperatures can thereby be suppressed.

(13) The space region R1 can be enclosed and formed by the second frame 86 coming in contact with the front surface 70*a* of the sheet 70. The space region R2 can be enclosed and formed by the second frame 87 coming in contact with the reverse surface 70*b* of the sheet 70.

(14) The areas of the space regions R1, R2 can be varied by the movable frames 92, 93 moving relative to the fixed frames 90, 91, respectively, along the conveying direction X.

(15) After the drying, since the sheet 70 is conveyed while being sandwiched by the cylindrical leveling roller 99, the sheet 70, which has been deformed by the pressure increase, can then be flattened.

The embodiments described above may be modified to other embodiments as follows.

In the drying apparatus 15, the ring frames 43 may be omitted and the drying process may be performed in a linear conveying route.

Two orientation-holding members 47 may be provided to each the holding parts 44 of the drying apparatus 15, and the support shafts 51 of the orientation-holding members 47 may be connected to the ends of the first shaft 55.

In the drying apparatus 15, the suction step may be omitted.

In the drying apparatus 15, the orientation-holding member 47 may be omitted, and the blow fan 45 may blow hot air from below onto the bag 17 which is held by the holding parts 44 so that the opening 17*b* faces downward.

A plurality of air intake/exhaust ports 45*a* may be provided to one blow fan 45. In this case, a plurality of bags 17 can be increased in pressure simultaneously by one blow fan 45.

In the drying apparatus 71, a blow fan 97 capable of blowing out and drawing in air may be used, and the suction step may be provided before the space region opening step. In this case, in the suction step, the state of increased pressure of the sheet 70 can be dispelled by the blow fan 97 suctioning out and discharging the air in the space region R2.

In the pressure increase step, the heated liquid may be filled into the space region. In this case, the surfaces exposed to the liquid in both the bag 17 or sheet 70 for packaging foodstuffs, for example, can be sterilized simultaneously.

The frame members need not have a movable members, the frame members may have movable frames extending along the conveying direction X and fixed frames extending along the width direction Y, or the frame members may have movable frames extending along the conveying direction X and movable frames extending along the width direction Y.

The frame members are not limited to forming rectangular space regions, and frame members which form space regions in the form of spheres, polygons, or other desired shapes can be used.

The blow fans 45, 97 may supply air that has been cooled to a lower temperature than room temperature after supplying air that has been heated by the heaters 48, 97*b*.

In the drying method, the cooling step may be omitted.

In the pressure increase step, the surface on which the recording process has been performed may be increased in pressure. In this case, the pressure of the space region to which the front surface is exposed can be increased by providing a frame member which encloses and forms the space region by coming in contact with the front surface of the bag 17.

The air-blowing fans 49, 94 may be omitted from the configuration, or the configuration may include air-blowing fans 49, 94 that do not have heaters 50, 94*a*.

The temperatures of the hot air and warm are as well as the pressures of the space regions can be varied as desired.

The ink cartridges 21 may be ink tanks that cannot be removed.

Any desired material and shape can be used for the target.

The printer 11 may be actualized as a full line type of line head printer having a rectangular fluid ejection head, a lateral printer, or a serial printer having a fluid ejection head capable of moving along the width direction Y.

In the embodiments described above, the recording apparatus was specified as an inkjet printer, but a fluid ejection device that ejects or discharges a fluid other than ink may also be used. The present invention is applicable to various liquid ejection devices comprising liquid ejection heads or the like for discharging droplets in extremely small amounts. The term "droplets" refers to the state of the liquid discharged from the liquid ejection device, and includes that which leaves trails of grains, tears, or threads. The liquid referred to herein need only be a substance that can be ejected by the liquid ejection device. For example, the material need only be in the state of a liquid which includes not only fluids such as liquids of high and low viscosity, sols, gels, other inorganic solvents, organic solvents, solutions, liquid resins, and liquid metals (metal melts); and liquids as one state of the substance; but also includes liquids containing functional materials composed of pigments, metal particles, or the like which are dissolved, dispersed, or mixed in a solvent. Typical examples of the liquids include ink such as the ink described in the embodiments described above, liquid crystal, and the like. The term "ink" used herein includes common water-based ink and oil-based ink, as well as gel ink, hot melt ink, and other various liquid compositions. Specific examples of the liquid ejection device include liquid ejection devices which eject a liquid containing an electrode material, a coloring material, or the like in the form of a dispersion or a solvent, which is used in the manufacture of liquid crystal displays, EL (electroluminescence) displays, surface-emitting displays, color filters, and the like, for example; liquid ejection devices which eject a biological organic substance used to manufacture biochips; liquid ejection devices which are used as precision pipettes and which eject a liquid as a test sample; stain-printing devices, micro dispensers; and the like. Further options which may be used include liquid ejection devices which eject lubricating oil at pinpoints onto watches, cameras, and other precision instruments; liquid ejection devices for ejecting an ultraviolet curing resin or another transparent resin liquid onto a substrate in order to form a microscopic semispherical lens (optical lens) or the like used in an optical communication element or the like; and liquid ejection devices for ejecting an acid, an alkali, or another etching liquid in order to etch a substrate or the like. The present invention can be applied to any one of these types of liquid ejection devices.

Furthermore, the technological ideals intended by the embodiments and modifications described above are summarized as follows.

The subsequent process apparatus is characterized in comprising a fluid supply mechanism for supplying a fluid as a heat medium for controlling the target to the desired temperature, wherein the target is increased in pressure from one surface side by the fluid supply mechanism supplying the fluid to a space region to which the one surface side of the target is exposed.

According to this configuration, since the pressure of the target is increased from the one side surface by the fluid supply mechanism supplying fluid as a heat medium to the space region, uneven temperatures can be reduced when the target is controlled to the desired temperature. Specifically, the drying process is not limited to heating, and in cases in which a cooling process is performed as a subsequent process, the target may be cooled while being increased in pressure by supplying cooled fluid to the space region.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A drying apparatus comprising:

a fluid supply mechanism configured to supply a fluid as a heat medium for controlling a target to a desired temperature, the fluid supply mechanism being configured to supply the fluid to a space region disposed on one surface side of the target to increase pressure on the target from the one surface side, wherein a recording process is performed on the front surface side of the target, and the fluid supply mechanism supplies the fluid to the space region disposed on the reverse surface side of the target.

2. The drying apparatus according to claim 1, wherein the target is a bag having an opening, and the fluid supply mechanism increases the pressure in the bag from the inside by filling the bag with the fluid through the opening.

3. The drying apparatus according to claim 2, further comprising an opening/closing mechanism configured to open and close the opening of the target.

4. The drying apparatus according to claim 2, further comprising a holding part configured to hold the target, a rotating member configured to rotate in a state of supporting a plurality of the holding parts, and an orientation-holding member configured to hold the orientation of the target during the rotation.

5. The drying apparatus according to claim 1, further comprising a frame member that comes in contact with one surface side of the target to form enclosing and form the space region.

6. The drying apparatus according to claim 5, wherein the frame member includes a fixed frame extending along a conveying direction of the target and a movable frame extending along a width direction of the target, which is orthogonal to the conveying direction, the movable frame is provided so as to be movable relative to the fixed frame along the conveying direction.

7. The drying apparatus according to claim 1, further comprising an air-blowing fan for blowing air onto the front surface side of the target.

8. The drying apparatus according to claim 1, wherein the fluid supply mechanism has a heater configured to heat the fluid, and after the fluid heated by the heater has been supplied, room temperature fluid that has not been heated by the heater is supplied in order to reduce the temperature of the target while the pressure applied to the space region is maintained.

9. The drying apparatus according to claim 1, further comprising a suction device configured to suction the space region.

10. A recording apparatus comprising:

a recording unit configured to perform the recording process on the target; and the drying apparatus according to claim 1.

11. A drying method comprising:

performing a recording process on the front surface side of a target; and increasing the pressure on the target from the reverse surface side by supplying a space region disposed on the reverse surface side of the target, with a fluid as a heat medium for controlling the target to a desired temperature.

* * * * *